US010243309B2

(12) United States Patent
Wong et al.

(10) Patent No.: US 10,243,309 B2
(45) Date of Patent: Mar. 26, 2019

(54) ENGINE BLOCK HEATER CORD SET

(71) Applicant: Electrical Components International, Inc., St. Louis, MO (US)

(72) Inventors: Ping-Chung Wong, Oakville (CA); Daniel P. McNaught, Mississauga (CA)

(73) Assignee: Electrical Components International, Inc., St. Louis, MO (US)

( * ) Notice: Subject to any disclaimer, the term of this patent is extended or adjusted under 35 U.S.C. 154(b) by 23 days.

(21) Appl. No.: 15/676,442

(22) Filed: Aug. 14, 2017

(65) Prior Publication Data

US 2017/0358896 A1 Dec. 14, 2017

Related U.S. Application Data

(63) Continuation of application No. 15/380,549, filed on Dec. 15, 2016, now Pat. No. 9,762,011.

(60) Provisional application No. 62/269,426, filed on Dec. 18, 2015.

(51) Int. Cl.

| | |
|---|---|
| ***H01R 27/00*** | (2006.01) |
| ***H01R 24/86*** | (2011.01) |
| ***F02N 19/02*** | (2010.01) |
| ***F02B 77/11*** | (2006.01) |
| *H01R 103/00* | (2006.01) |
| *F01M 5/02* | (2006.01) |
| *H01R 11/09* | (2006.01) |
| *H01R 24/22* | (2011.01) |

(52) U.S. Cl.

CPC ..... *H01R 24/86* (2013.01); *F02B 77/11* (2013.01); *F02N 19/02* (2013.01); *F01M 5/02* (2013.01); *H01R 11/09* (2013.01); *H01R 24/22* (2013.01); *H01R 2103/00* (2013.01); *H01R 2201/26* (2013.01)

(58) Field of Classification Search

CPC ..... H01R 24/86

USPC ..... 439/682, 685, 218, 223, 919, 640, 208

See application file for complete search history.

(56) References Cited

U.S. PATENT DOCUMENTS

| | | | | |
|---|---|---|---|---|
| 2,537,183 A * | 1/1951 | Bloomer | ..... | F16L 5/06 285/210 |
| 3,969,605 A * | 7/1976 | Danell | ..... | F02N 19/10 123/142.5 E |
| 4,245,875 A | 1/1981 | Shaffer et al. | | |

(Continued)

*Primary Examiner* — Abdullah A Riyami

*Assistant Examiner* — Nelson R. Burgos-Guntin

(74) *Attorney, Agent, or Firm* — Gable Gotwals

(57) ABSTRACT

An engine block heater and an engine block heater cord set. The heater has a cavity formed from a plurality of opposed lobes spaced symmetrically about its upper end. The lobes matingly engage a connector of a cord set. First and second electrical terminal are disposed within opposed lobes and are electrically coupled to a heating element. The cord set comprises an electrical power cord engagable with the heater. A connector includes a plurality of power contacts, where the number of power contacts is four or more and a multiple of two. Each of the power contacts is electrically bonded to one of first and second electrical conductors. The power contacts are positioned symmetrically relative to one another on the connector with diagonally opposite contacts having a different polarity and spaced apart by a distance generally equal to the distance between the electrical terminals of the heater.

4 Claims, 3 Drawing Sheets

(56) References Cited

U.S. PATENT DOCUMENTS

| | | | | | |
|---|---|---|---|---|---|
| 4,485,771 | A * | 12/1984 | Brinkhof | F02N 19/02 | 123/142.5 E |
| 4,634,834 | A * | 1/1987 | Lupoli | H05B 3/04 | 123/142.5 E |
| 4,726,786 | A | 2/1988 | Hill | | |
| 4,727,239 | A * | 2/1988 | Lupoli | H05B 3/04 | 123/142.5 E |
| 4,971,576 | A * | 11/1990 | Thimmesch | F01M 5/021 | 219/205 |
| 5,664,959 | A | 9/1997 | Duell et al. | | |
| 5,951,332 | A | 9/1999 | Wang | | |
| 6,152,780 | A | 11/2000 | Burke | | |
| 7,207,844 | B2 | 4/2007 | Peng | | |
| 7,255,568 | B1 | 8/2007 | Wu | | |
| 7,353,810 | B1 * | 4/2008 | Blaschke | F02M 31/125 | 123/549 |
| 8,721,371 | B2 | 5/2014 | Picker et al. | | |
| 2011/0155714 | A1 * | 6/2011 | Thomas | B60L 1/12 | 219/205 |
| 2017/0179654 | A1 * | 6/2017 | Wong | H01R 24/86 | |
| 2017/0358896 | A1 * | 12/2017 | Wong | H01R 24/86 | |

* cited by examiner

ENGINE BLOCK HEATER CORD SET

CROSS-REFERENCE TO RELATED APPLICATION

This application claims priority to U.S. Provisional Patent Application No. 62/269,426 filed 18 May 2014, which is incorporated herein by reference.

FIELD

This invention relates generally to engine block heaters, and in particular to an engine block heater.

BACKGROUND

Engine block heaters are common accessories used on internal combustion engines in cold climates. Engine block heaters aid in warming engine blocks when the engines are not in operation. Among other advantages a warmed engine provides for easier starting, can help to reduce emissions, and aids in warming the passenger compartment where the engine is used in an automobile. Although engine block heaters are commonly used in association with cars and trucks, they may also be used on recreational vehicles, construction equipment, and on most other applications that utilize an internal combustion engine. While there are many different forms, sizes and configurations of engine block heaters (each being designed for particular application on particular engines) all conventional engine block heaters include an electrical heating element that is connected or otherwise secured to the engine block, or a component thereof, and that has attached or attachable to it an electrical cord to supplies electricity to the heating element. Typically, household voltage (which most commonly will be 110 or 220 volts depending on the jurisdiction) is applied to a resistive heating element, causing it to heat up, and in turn causing the element to heat or warm the engine block.

Engine block heaters are generally of two main types; namely, cartridge heaters or immersion heaters. Cartridge heaters have their heating elements sealed within a cylindrical cartridge that is received within a correspondingly shaped bore within the engine block. The cartridges do not come into direct contact with the interior or the operational fluids of the engine. As the cartridge is heated, so is the engine block. Immersion heaters are commonly threaded through a bore in the side of the engine block such that their heating elements are immersed within engine coolant inside the block, much as in the case of an electric heating element used in an electric water heater. As the element is heated it transfers heat to the engine coolant.

Automobile manufacturers are increasingly attempting to better utilize the available space within the engine compartment of a car or truck in order to reduce the overall size of the vehicle and to generally help to increase its operating efficiency. As a result, the amount of open or available space for the installation of accessories such as engine block heaters has been reduced over time. In many instances engine block heaters must be installed in tight quarters, with their cords having to be routed around obstacles, components that may be hot to the point that they could cause damage to the cord if it were to come into contact with them, or around sharp or moving parts that could damage the cord.

In most instances, the engine block heater is comprised of a heating element and a separate, detachable, cord set. The cord sets are manufactured such that they can be separated from the heating element, largely to allow for the replacement of one, or the other, of the cord set and the heating element should one become damaged or malfunction. Installation of such engine block heaters requires that the heating element be attached or otherwise secured to the engine block, after which one end of the cord set is connected to the heating element with the opposite end being routed through the engine compartment to a location that permits it to be connected to a source of electricity. On account of the confined space within which the engine compartment, many cord sets are designed with a 90 degree connector to secure the cord set to the heating element, thereby reducing the overall length of the assembled unit. Unfortunately, current cord sets and heater elements permit the cord to be mounted to the heater in a single orientation, meaning that the cord extends outwardly from the heating element in a single, fixed, direction. With the orientation of the power cord fixed relative to the heating element, an installer is thus limited in terms of his or her ability to easily route the cord set away from obstacles, heated objects within the engine compartment, sharp surfaces and moving parts. To accommodate different installation scenarios, installers are often forced to have on hand an inventory of multiple cord sets having differently oriented electrical connectors for mating with the contacts of the heating element, depending on its final position when installed in the engine.

SUMMARY OF THE INVENTION

In one aspect there is provided an engine block heater cord set for delivering electricity from a source to first and second electrical terminals of an engine block heater, the cord set comprising an electrical power cord containing at least first and second electrical conductors, said first and second electrical conductors of a different polarity when said electrical power cord is energized, said electrical power cord terminating at one end in a connector that is releasably engagable with the engine block heater such that when said connector is engaged with the engine block heater one of said first and second electrical conductors is electrically bonded to one of the first and second electrical terminals with the other of said first and second electrical conductors electrically bonded to the other of the first and second electrical terminals, said connector including a plurality of power contacts, where the number of power contacts is four or more and a multiple of two, each of said power contacts electrically bonded to one of said first and second electrical conductors, said power contacts positioned symmetrically relative to one another on said connector with diagonally opposite contacts having a different polarity and electrically bonded to opposite ones of said first and second conductors, diagonally opposite contacts spaced apart by a distance generally equal to the distance between the electrical terminals of the engine block heater such that the engagement of said connector with the engine block heater causes two diagonally opposite contacts to electrically bond with the terminals of the engine block heater.

In another aspect there is provided an engine block heater cord set for delivering electricity from a source to first and second electrical terminals of an engine block heater, the cord set comprising an electrical power cord containing at least first and second electrical conductors, said first and second electrical conductors of a different polarity when said electrical power cord is energized, said electrical power cord terminating at one end in a connector that includes an extension with at least a portion of the extension releasably receivable within a cavity within the engine block heater such that when said extension is received within the cavity one of said first and second electrical conductors is electrically bonded to one of the first and second electrical terminals with the other of said first and second electrical conductors electrically bonded to the other of the first and second electrical terminals, said extension including four power contacts symmetrically spaced relative to one another about said connector and in a generally square configuration with diagonally opposite contacts of a different polarity and electrically bonded to opposite ones of said first and second conductors, said diagonally opposite contacts spaced apart by a distance generally equal to the distance between the electrical terminals of the engine block heater such that the receipt of said extension within the cavity causes two diagonally opposite contacts to electrically bond with the terminals of the engine block heater.

In another aspect there is provided an engine block heater comprising a heating element; and a support member, the support member including an upper end having a cavity formed from a plurality of opposed lobes spaced symmetrically about the upper end, the cavity dimensioned to matingly engage a connector of a cord set, the support member further including a first electrical terminal disposed within one of the plurality of lobes and a second electrical terminal disposed within an opposed lobe, the first and second electrical terminals electrically coupled to the heating element, wherein, when the connector is engaged with the cavity, the first and second electrical terminals are electrically bonded to electrical conductors of the connector to supply electricity from the cord set to the heating element.

DESCRIPTION

Figure 1:
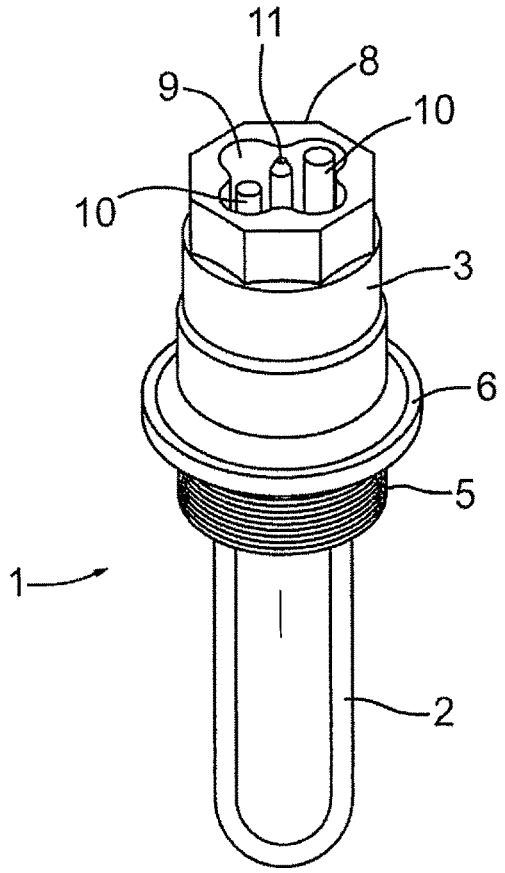
FIG. 1 is an upper side perspective view of a representative embodiment an engine block heater for use in association with an engine block heater cord set constructed in accordance with an embodiment of the invention.
Figure 2:
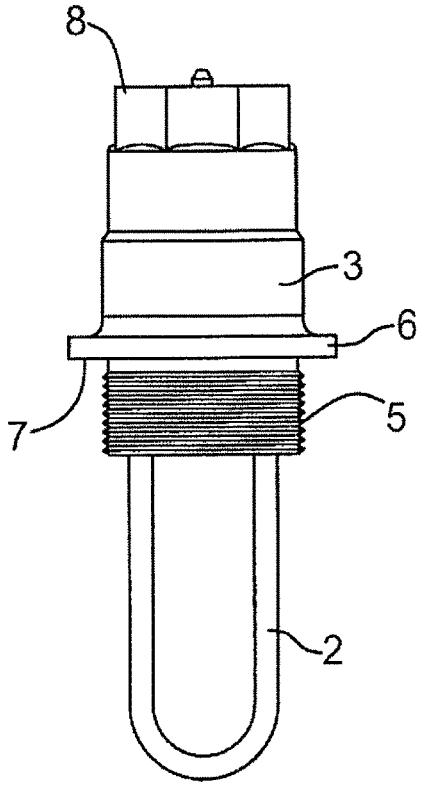
FIG. 2 is a side elevation view of the engine block heater of FIG. 1.
Figure 3:
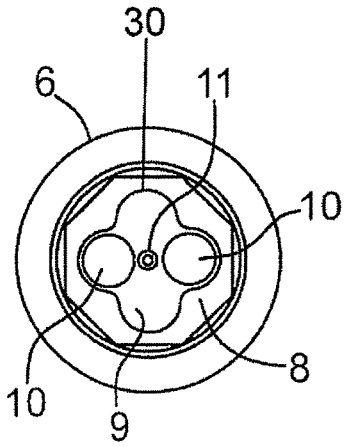
FIG. 3 is a plan view of the engine block heater of FIG. 1.
Figure 4:
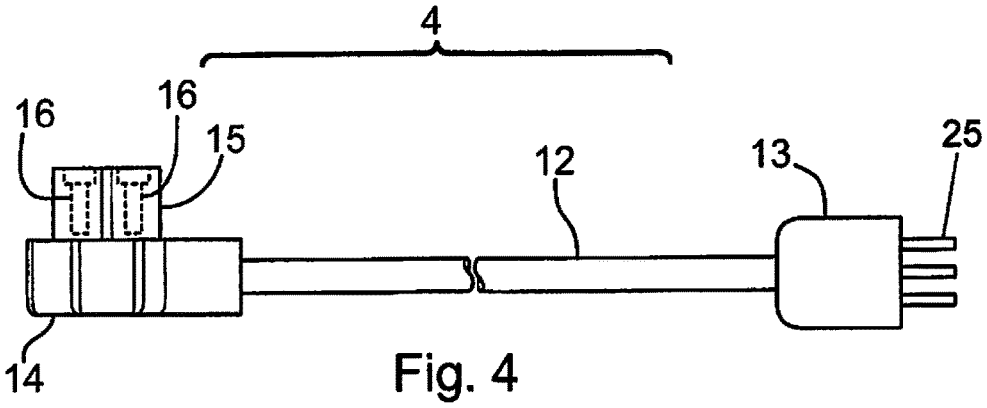
FIG. 4 is a side view of a representative embodiment of a power cord set for use in association with the engine block heater shown in FIG. 1.

The attached drawings show an engine block heater constructed in accordance with a preferred embodiment of the invention. FIGS. 1 through 3 depict what is generally referred to as the "heater" 1 (generally comprised of an electric heating element 2 and a support member 3). In the particular embodiment shown the engine block heater is an immersion type heater, however, it will be appreciated that in other embodiments the engine block heater could be a cartridge type heater. FIGS. 4 through 7 show an electrical cord set 4 that supplies power to the heater.

With specific reference to FIGS. 1 through 3, heater 1 is of a form that is designed for threading into an open hole in the side of an engine block. For that reason, support member 3 contains threads 5 that matingly receive corresponding threads in the engine block to secure the heater thereto. Support member 3 may also include a circumferential flange 6 that provides for generally sealing or mating against the surface of the block. Often a gasket, O ring or other sealing mechanism will be inserted between the lower surface 7 of flange 6 and the exterior surface of the engine block to help seal the opening in the block through which the heater passes. One of ordinary skill in the art will also appreciate from a thorough understanding of the invention that although heater 1 shown in FIGS. 1 through 3 is threadably attached to the engine block, it could alternately be secured to the block through the use of a flange that is bolted or screwed to the block, or through any one of a variety of other mechanical means used to secure engine block heaters in place.

As mentioned, heater 1 could alternatively be of the cartridge type where the heater element is in the form of a cylinder that is closely received within a cylindrical shaped bore within the engine block. As is common in such heaters, the heater element will be dimensioned such that it contacts the interior surface of the bore within the block or is in very close proximity in order to enhance the transmission of heat from the heater element to the block.

Regardless of whether heater 1 is an immersion or a cartridge type heater it will typically include at its upper end 8 a cavity or receptacle 9 that houses a pair of electrical terminals 10 that are designed to receive electricity from cord set 4 and deliver it to a resistive element. For safety purposes, and in many instances to comply with local regulations and by-laws, cavity 9 may also include a ground post or terminal 11 for electrically bonding with a ground wire 18 in cord set 4.

As is relatively common with engine block heaters, cord set 4 is comprised generally of an elongate electrical power cord 12 that will typically include three separate conductors. Two of those conductors are used to conduct electricity to heater 1, while the third represents a ground wire. One end of electrical cord 12 will be fitted with a male plug 13 for receipt within a standard receptacle to deliver household power to energize the cord set. The opposite end of electrical cord 12 is fitted with a connector 14 for mating with heater 1. It will be appreciated that where the heater is in a form similar to that shown in FIGS. 1 through 3 (with the upper end 8 of the heater including a cavity 9 that houses electrical terminals 10), connector 14 will be a male connector having an extension 15 for receipt within cavity 9. It should also be noted that in an alternate embodiment the opposite could be the case, with connector 14 in the form of a female connector that houses the cavity, and with the upper end of the heater in the form of a male extension for receipt within the female connector.

Preferably, extension 15 is dimensioned to be closely and tightly received within cavity 9 in order to present a weather resistant connection between connector 14 and heater 1. In that regard, extension 15 (and in many instances connector 14 in general) may be formed from a silicone, a high temperature rubber or plastic, or a similar material that is capable of withstanding the temperature differentials to which it may be exposed during operation, while at the same time permitting a weather or moisture resistant seal to be formed between the exterior surface of extension 15 and the interior surface of cavity 9. Situated within extension 15 will be electrical contacts 16 that form an electrical bond or connection with terminals 10 and ground post 11 of cavity 9 when extension 15 is received within the cavity. In that manner, electricity provided through connecting male plug 13 to an external power source will be delivered to the heater.

In the case of currently available engine block heaters, the connectors 14 used in association with cord sets 4 contain two electrical contacts (or possibly three where a ground wire is involved) for electrically bonding with terminals within the heater. Unique to the current invention is the use of more than two electrical contacts (not counting any ground contact) within connector 14.

Figure 5:
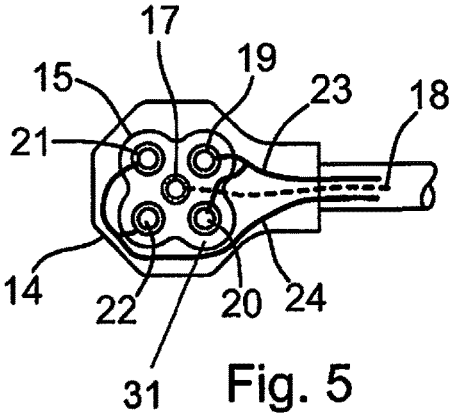
FIG. 5 is a bottom view of the engine block heater connector of the power cord set shown in FIG. 4.
Figure 6:
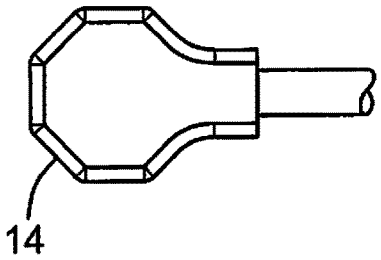
FIG. 6 is a plan view of the connector of the power cord set shown in FIG. 4.
Figure 7:
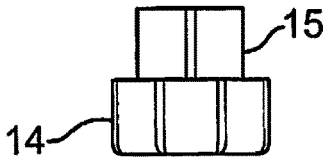
FIG. 7 is a left hand end view of the power cord set shown in FIG. 4.

With specific reference to FIG. 5, in the embodiment of the invention depicted, extension 15 of connector 14 is shown as including five electrical contacts. In this instance a central contact 17 is a "ground" contact and is connected to a ground wire 18 (shown in dashed lines within the Figure). Spaced symmetrically about, and generally an equal distance from, central contact 17 are four "power" contacts 19, 20, 21 and 22. In accordance with this embodiment of the invention contacts 19 and 20 are each connected to a first electrical conductor or wire 23, whereas contacts 21 and 22 are each connected to a second electrical conductor or wire 24. As shown in the embodiment of FIG. 5, electrical contacts 19 or 20 are symmetrical with electrical contacts 21 and 22 about central (ground) contact 17. Further, electrical contacts 19 and 20 are of a polarity different from the polarity of electrical contacts 21 and 22. That is, diagonally opposite electrical contacts are of a different polarity. Further, diagonally opposite contacts are spaced apart by a distance generally equal to the distance between the terminals 10 of cavity 9. Electrical conductors or wires 23 and 24 are connected to different line prongs 25 in male plug 13 and are of different polarity when the cord set is energized. In this manner electricity may be applied to heater 1 to cause a heating of its element through the connection of one of power contacts 19 and 20 with one of terminals 10, and the connection of one of power contacts 21 and 22 with the other of the terminals in the heater.

In accordance with an embodiment of the invention, the interior of cavity 9 and the exterior shape of extension 15 are designed not only so as to permit the extension to be generally sealingly received within the cavity, but also to permit the extension to be received in a plurality of different designated orientations (or to permit connector 14 to be "indexed") relative to heater 1. That is, in one embodiment the exterior of extension 15 is non-circular and symmetrical in cross section, with cavity 9 having a complementary shape such that the position of connector 14 relative to engine heater 1 can be "indexed" through the rotation and the receipt of the extension into the cavity. It will be appreciated that through use of a non-circular extension the "positioning" of the power contacts in the extension relative to the position of the terminals in cavity 9 can be predetermined through manufacturing. However, in some instances the exterior of extension 15 may be circular in cross-section, meaning an installer may need to use slightly more care to align the power contacts of the extension with terminals 10 of the cavity when connecting the cord set to the heater.

It should also be appreciated that the "sealing" engagement of extension 15 within cavity 9 is meant to signify that the extension is received within the cavity in a manner that generally helps to limit the ingress of water and/or moisture and/or debris into the cavity. In some instances separate seals (o-rings, etc) may be employed to enhance the sealing relationship between the extension and the cavity. In other instances a simple friction fit may suffice. "Seal" or 'sealingly" within the context of the invention is not meant to imply any specific degree of seal or compliance with any particular engineering or industry standards.

In the particular embodiment that is shown, cavity 9 has a series of four lobes 30 that are uniformly spaced about the interior circumference of the cavity (see FIG. 3). Extension 15 is designed with a similar or corresponding exterior shape, having four similarly shaped lobes 31 uniformly positioned about its circumference. This particular configuration of extension 15 and cavity 9 therefore presents four distinct possible orientations of connector 14 relative to heater 1 when extension 15 is received within cavity 9. It will be understood that the utilization of power contacts 19, 20, 21 and 22, and the particular electrical connection of those contacts to conductors 23 and 24, will enable electricity to be conducted to terminals 10 in an appropriate manner regardless of the particular orientation of connector 14 relative to the heater. That is, in each of the four potential orientations of connector 14, one of the electrical terminals 10 in cavity 9 will be connected or electrically bonded (through a power contact) to one of conductors or wires 23 and 24, with the other of the electrical terminals 10 being bonded (though a diagonally opposite power contact) with the other conductor or wire 23 or 24. Those power contacts that are not electrically bonded to one of the terminals 10 will have no effect on the functionality of the cord set once connector 14 is received within cavity 9.

Although in the attached drawings extension 15 and cavity 9 are shown as including four correspondingly shaped lobes, it will be appreciated and understood that a variety of other shapes and number of lobes could be potentially be utilized for both the cavity and the extension. For example, while in the attached drawings lobes 30 and 31 are generally rounded, they could equally be squared off, generally triangular, etc. It will also be understood that extension 15 and cavity 9 could potentially include more than four lobes, resulting in more than four possible orientations of connector 14, while at the same time providing a means to supply electricity to the heater and its resistive element. Extension 15 and cavity 9 may have 4 or more lobes with the overall number of lobes (n) being a multiple of 2. As mentioned above, diagonally opposite power contacts will be of a different polarity. Further, it will also be appreciated that diagonally opposite contacts will be spaced apart by a distance generally equal to the distance between the electrical terminals 10 in cavity 9. It will further be appreciated that other combinations of power contacts and their connection to wires 23 and 24 could be utilized.

Figure 8:
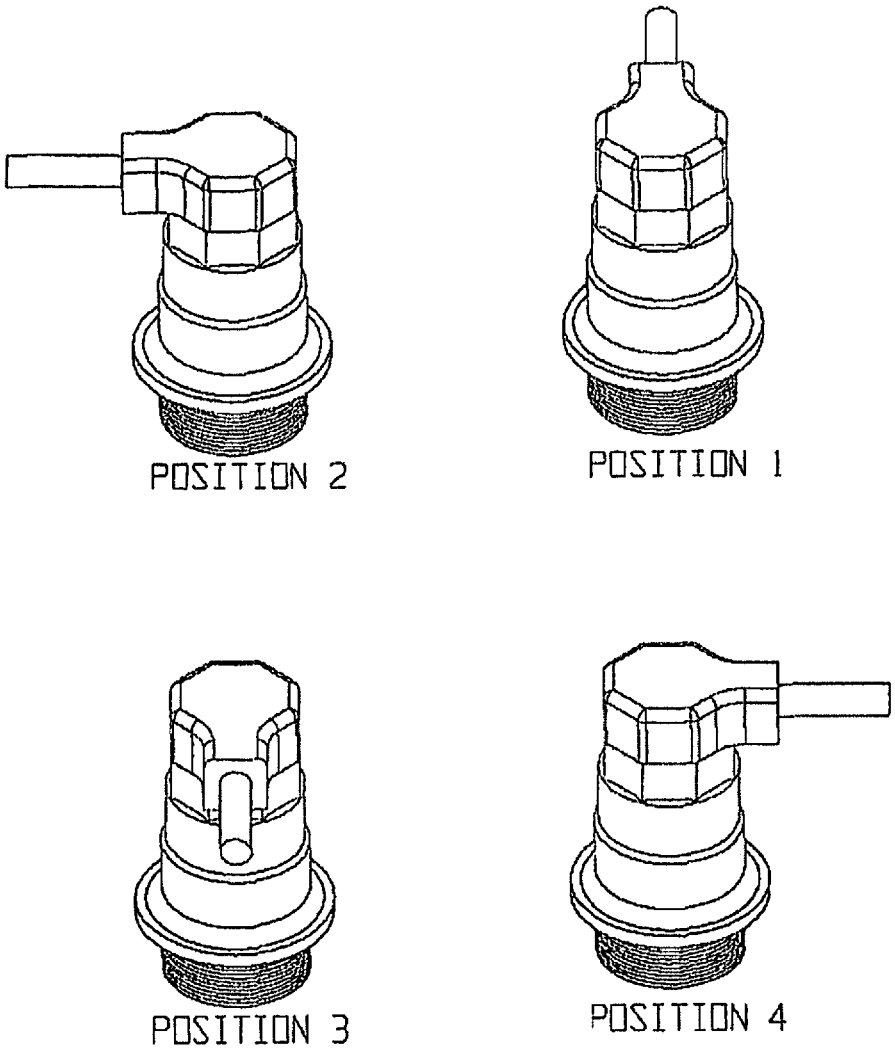
FIG. 8 shows the power cord set of FIG. 4 secured to an engine block heater (without the heater element being shown) in each of four different possible orientations.

The described invention thus provides the ability to position connector 14 relative to heater 1 in a plurality of different orientations. In the particular cord set shown in FIGS. 4 through 7, connector 14 is a right angle connector with electrical cord 12 at an approximate right angle to extension 15. Through using a right angle connector the overall length of the heater with the cord set secured is minimized such that the engine block heater is more readily received within tight or cramped locations. FIG. 8 depicts the four different positions of connector 4 relative to heater 1 that can be achieved through the utilization of the particular embodiment of the cord set that is shown in the attached drawings. The ability to position connector 14 in one of at least four different orientations relative to heater 1, when the heater is installed in the engine block, presents the installer with an enhanced degree of flexibility to feed or route electrical cord 12 through and around obstacles, and to avoid hot, sharp or moving parts within the engine compartment. The particular extension 15 and cavity 9 shown in the attached drawings and described above also helps to remove the need for installers to have on hand multiple cord sets to mate with the heater, depending on its final orientation when installed. The unknown final position of the electrical terminals in the heater is accommodated by the ability to orient connector 14 in a plurality of positions while still deliver electricity to the heating element and maintaining a proper polarity between contacts 19/20/21/22 and terminals 10.

It is to be understood that what has been described are the preferred embodiments of the invention. The scope of the claims should not be limited by the preferred embodiments set forth above, but should be given the broadest interpretation consistent with the description as a whole.

The invention claimed is:

1. An engine block heater comprising:

a heating element; and a support member, the support member including an upper end having a cavity formed from a plurality of opposed lobes spaced symmetrically about the upper end, the cavity dimensioned to matingly engage a connector of a cord set, the support member further including a first electrical terminal disposed within one of the plurality of lobes and a second electrical terminal disposed within an opposed lobe, the first and second electrical terminals electrically coupled to the heating element, when the connector is engaged with the cavity, the first and second electrical terminals are electrically bonded to electrical conductors of the connector to supply electricity from the cord set to the heating element.

2. The engine block heater as claimed in claim 1 wherein said cavity is formed from four lobes spaced symmetrically about said cavity forming two pair of diametrically opposed lobes.

3. The engine block heater as claimed in claim 2, wherein said lobes are arranged in a generally square configuration, with the first and second electrical terminals being positioned in diametrically opposite lobes.

4. The engine block heater as claimed in claim 3, further comprising a ground terminal centrally located within the cavity and positioned generally equidistant from the first and second electrical terminals, the ground terminal adapted to electrically bond with a ground wire in the cord set when the connector is engaged with the cavity.

* * * * *